US010144150B2

(12) United States Patent
Van Acoleyen

(10) Patent No.: US 10,144,150 B2
(45) Date of Patent: Dec. 4, 2018

(54) HATSCHEK PROCESS FOR THE PRODUCTION OF FIBER CEMENT PLATES

(71) Applicant: REDCO NV, Kapelle-op-den-Bos (BE)

(72) Inventor: Bertrand Van Acoleyen, Kapelle-op-den-Bos (BE)

(73) Assignee: Redco NV, Kapelle-op-den-Bos (BE)

( * ) Notice: Subject to any disclaimer, the term of this patent is extended or adjusted under 35 U.S.C. 154(b) by 583 days.

(21) Appl. No.: 14/779,750

(22) PCT Filed: Mar. 30, 2014

(86) PCT No.: PCT/EP2014/056386
§ 371 (c)(1),
(2) Date: Sep. 24, 2015

(87) PCT Pub. No.: WO2014/170119
PCT Pub. Date: Oct. 23, 2014

(65) Prior Publication Data

US 2016/0052163 A1 Feb. 25, 2016

(30) Foreign Application Priority Data

Apr. 15, 2013 (EP) ..... 13163835

(51) Int. Cl.
*B28B 1/52* (2006.01)

(52) U.S. Cl.
CPC ..... *B28B 1/526* (2013.01); *B28B 1/527* (2013.01)

(58) Field of Classification Search
CPC ..... B28B 1/526; B28B 1/527
See application file for complete search history.

(56) References Cited

U.S. PATENT DOCUMENTS

| | | | | |
|---|---|---|---|---|
| 2,118,762 A | | 5/1938 | Leonard, Jr. | |
| 2,573,659 A | * | 10/1951 | Bollaert | C04B 28/02 162/126 |
| 2,581,210 A | | 1/1952 | Simpson | |
| 3,344,015 A | * | 9/1967 | Neal | B28B 1/42 162/122 |
| 4,187,130 A | * | 2/1980 | Kautz | B28B 1/526 106/711 |

(Continued)

FOREIGN PATENT DOCUMENTS

| | | |
|---|---|---|
| GB | 675713 | 7/1952 |
| NL | 7704273 | 10/1977 |
| NL | 7712642 | 5/1978 |

*Primary Examiner* — Jeffrey M Wollschlager
(74) *Attorney, Agent, or Firm* — Dilworth & Barrese, LLP

(57) ABSTRACT

A Hatschek process for the production of profiled fiber cement plates is provided. The process comprises the steps of: (i) providing an endless fiber cement multilayered slab stacking at least one monolayer of a first type having a first width and at least one monolayer of a second type of monolayers having a second width, the at least one monolayer of a second type of monolayers extending in transverse direction beyond the at least one monolayer of a first type of monolayer: (ii) accumulating at least one layer of the endless fiber cement multilayered slab on a profiled accumulator roll having a recess along at least part of its circumference whereby the at least first monolayer is provided within the recess; (iii) removing the accumulated slab from the accumulator roll; and (iv) curing the uncured fiber cement plate.

13 Claims, 7 Drawing Sheets

(56) References Cited

U.S. PATENT DOCUMENTS

| | | | | | |
|---|---|---|---|---|---|
| 4,543,159 | A * | 9/1985 | Johnson | C04B 28/04 | 162/164.1 |
| 4,645,548 | A * | 2/1987 | Take | B28B 1/527 | 156/39 |
| 4,743,414 | A | 5/1988 | Sudrabin | | |
| 5,681,428 | A * | 10/1997 | Nakajima | B28B 1/527 | 162/117 |
| 5,851,354 | A * | 12/1998 | Sakiyama | C04B 22/148 | 162/123 |
| 5,858,083 | A * | 1/1999 | Stay | A62D 1/0007 | 106/672 |
| 5,891,516 | A * | 4/1999 | Gstrein | B28B 1/527 | 427/189 |
| 6,138,430 | A * | 10/2000 | Van Acoleyen | B28B 1/527 | 52/518 |
| 6,824,715 | B2 * | 11/2004 | Cottier | B28B 1/522 | 264/101 |
| 7,223,311 | B2 * | 5/2007 | Conboy | B28B 11/16 | 156/347 |
| 7,713,615 | B2 * | 5/2010 | Black | B28B 1/002 | 428/294.7 |
| 2003/0046891 | A1 * | 3/2003 | Colada | B28B 1/002 | 52/518 |
| 2007/0155272 | A1 * | 7/2007 | Baumgartner | B28B 1/527 | 442/320 |
| 2010/0043956 | A1 | 2/2010 | Hasegawa | | |
| 2012/0098161 | A1 * | 4/2012 | Breuer | B28B 1/527 | 264/337 |

* cited by examiner

HATSCHEK PROCESS FOR THE PRODUCTION OF FIBER CEMENT PLATES

This application is a 371 application of PCT/EP2014/056386, filed Mar. 30, 2014, the contents of which are incorporated by reference herein.

FIELD OF THE INVENTION

The present invention relates to Hatschek processes for the production of fiber cement plates, and fiber cement plates obtained using such processes.

BACKGROUND OF THE INVENTION

Hatschek processes for the production of fiber cement plates are well known in the art. Typically rectangular parallelepiped-shaped plates are formed. To provide a profiled shape, usually to provide tapered edges to the long sides of the plate, the excess of cured fiber cement is grinded or cut away.

Attempts to overcome this extra process step of material removal, which is relatively expensive, by accumulating uncured fiber cement slab as multilayered slab form the Hatschek machinery on a profiled accumulator roll. However the disadvantage is that the density and hence the physical properties of the plate with tapered edges, is different.

SUMMARY OF THE INVENTION

It is an object of the present invention to provide a process for providing profiled fiber cement plates, having tapered or beveled edges at at least two parallel sides of the plate, which has less deviation in density across the plate in transversal direction.

The above objective is accomplished by processes according to the present invention.

According to a first aspect of the present invention, a Hatschek process for the production of profiled fiber cement plates is provided, the process comprising the steps of

- Providing an endless fiber cement multilayered slab in a production direction by stacking at least one monolayer of a first type of monolayer having a first width (W1) in transverse direction (115) and at least one monolayer of a second type of monolayers having a second width (W2) in the transverse direction, the first width (W1) being less than the second width (W2), the at least one monolayer of a second type of monolayers extending in transverse direction beyond the at least one monolayer of a first type of monolayer;
- Accumulating at least one layer of the endless fiber cement multilayered slab on a profiled accumulator roll, the accumulator roll having a recess in axial direction along at least part of its circumference, whereby the at least first monolayer is provided within the recess, thereby providing an accumulated slab;
- Removing the accumulated slab from the accumulator roll, thereby providing an uncured, profiled fiber cement plate;
- Curing the uncured fiber cement plate to provide the profiled fiber cement plate.

With transverse direction is meant the direction perpendicular to the production direction and perpendicular to the plate surface.

The at least one monolayer of a second type of monolayers extending in transverse direction beyond the at least one monolayer of a first type of monolayer means that the borders in process direction for the one or more monolayers of the second type of monolayers extend beyond the corresponding borders in process direction for the one or more monolayers of the first type of monolayers in transversal direction.

The profiled fiber cement plate so obtained, has the advantage that the density of the plate in transverse direction of the plate varies to a less extent as would be the case when merely a profiled accumulator roll were used. The density in the transversal direction varies only little, the deviation being usually less than 20%, or even is less than 15% of the average density.

The profile that is given is a tapered of beveled profile at both outer sides of the profiled fiber cement plate, wherein the slope of the profile can be varied by appropriate selection of the recess profile in the accumulator roll. The difference in thickness of the plate from the middle section of the plate to the edge of the plate may be up to 3 mm (millimeter), typically ranges up to 2 mm, and may be between 0.5 and 3 mm, such as between 0.5 mm and 2 mm, such as between 1 mm and 2 mm.

According to some embodiments, the recess may have a depth of between 0.5 mm and 3 mm. The recess, in axial direction typically being a trapezoid shaped recess, may have a depth up to 3 mm (millimeter), typically ranging up to 2 mm, and may be between 0.5 mm and 2 mm, such as between 1 mm and 2 mm. Trapezoid is to be under stood as a quadrilateral having exactly one pair of parallel sides.

According to some embodiments, the difference between the width (W1) of the first type of monolayers in transverse direction and the width (W2) of the second type of monolayers may be at least 40 mm.

Preferably the difference between the width W1 of the first type of monolayers in transverse direction and the width W2 of the second type of monolayers is at least 50 mm, e.g. at least 80 mm.

According to some embodiments, the multilayered slab further comprises n additional monolayers, n being an integer of at least 1, the width of each of the n additional monolayers in transversal direction may be more than the first width, and wherein each of the n additional monolayers extending in transverse direction beyond the first monolayer.

According to some embodiments, the n additional monolayers may be monolayers of the second type of monolayers.

According to some embodiments, the recess may have a trapezoid shape, the length of the radial projection of each of the legs of the trapezoid shape on the axis of the accumulator roll is in the range of 2 to 20 mm.

Preferably the length of the radial projection of each of the legs of the trapezoid shape on the axis of the accumulator roll is in the range of 5 to 15 mm, more preferred in the range of 10 to 15 mm.

According to some embodiments, the multilayered slab further may comprise m additional monolayers, the m monolayers being monolayers of the first type of monolayers.

According to some embodiments, the multilayered slab may consist of 2 to 8 monolayers. Preferably the multilayered slab consists of 2, 3, 4, 5, 6, 7 or 8 monolayers, though more monolayers are possible.

It is understood that the sequence of layers with different width may vary according to various patterns. As an example, the layer first provided in production direction may be the monolayer of the first type of monolayers with the smallest width, hence being the at least one monolayer with width W1. Thereafter the second and further layers in production direction sequence may all be of the second type of monolayers with a width W2 and extending in transversal direction beyond the first layer. Alternatively the second and subsequent layers may gradually have increasing widths in transversal direction, and each layer may extend in transversal direction beyond all previously provided monolayers. Alternatively the monolayer first provided in production direction may be the layer with the maximum width, such as the at least one monolayer of the second type of monolayers, the second and subsequent layers may gradually have decreasing widths in transversal direction, and each layer may be extended in transversal direction by all previously provided monolayers. It is understood that any other sequence may be used.

According to some embodiments, the at least one monolayer of a first type of monolayer may have a thickness different from the thickness of the at least one monolayer of a second type of monolayers.

The thicknesses of each of the monolayers may vary from 0.1 to 0.6 mm, syuc as between 0.2 and 0.5 mm, such as between 0.3 to 0.5 mm. As an example, the thickness of the monolayer may be 0.4 mm.

By varying the density of the slurries, one can influence to some extent the thickness of the monolayer when present in the multilayered slab, optionally during accumulation on the accumulator drum. This variation in density may facilitate the production of slightly different fiber cement plates using one and the same profiled accumulator drum.

According to some embodiments, each of the monolayers may be provided by accumulating fiber cement slurry on a rotating sieve drum and removing the accumulated fiber cement slurry from the rotating sieve drum as a monolayer, the width of the first type of monolayer in transverse direction being provided by obstructing at least part of the sieve at the outer ends in axial direction of the rotating sieve drum.

This obstruction can be obtained by providing a paint, typically a water resistant paint to the zone of the sieve to be prevented of accumulating slurry, or by providing a water impermeable tape or liner.

Alternatively rotating sieve drums with different the axial length of the rotating sieves may vary to provide the different monolayer widths.

According to some embodiments, each of the monolayers may be provided by accumulating fiber cement slurry on a rotating sieve drum and removing the accumulated fiber cement slurry from the rotating sieve drum as a monolayer, the width of the first type of monolayers in transverse direction being provided by removing the part of the accumulated fiber cement slurry from the sieve, which parts extends beyond the width to be provided.

According to some embodiments, the slurry may be removed by spraying water to the slurry to be removed.

According to some embodiments, the accumulator roll may have no recess in axial direction along at least 40 mm of its circumference. More preferably the accumulator roll has no recess in axial direction along at least 50 mm of its circumference, even along at least 100 mm or even along at least 150 mm The absence of the recess, typically along a minor part of the circumference, allows the fresh multilayered slab to be picked up by the accumulator roll after the former slab has been removed. It is understood that the strip of uncured fiber cement plate where the recess is not present, hence the profile of the plate is not provided, will be cut. The cut material will be recycled to the fiber cement slurry as is typically done in Hatschek processes.

According to some embodiments, the accumulator roll may have a recess in axial direction along its complete circumference, the process further comprising the use of a means to contact the at least one layer of the endless fiber cement multilayered slab to the accumulator roll in the recess at start of accumulation of the at least one layer of the endless fiber cement multilayered slab on a profiled accumulator roll.

Such means to contact the at least one layer of the endless fiber cement multilayered slab to the accumulator roll in the recess at start of accumulation may be a mechanical means, such as a bar or roller, that is suitable to press the fresh multilayered slab to at least part of recess along the circumference of the accumulator roll.

The fiber cement slurry typically comprises water, process or reinforcing fibers which both may be organic fibers (typically cellulose fibers) or synthetic fibers (polyvynilalcohol, polyacrilonitrile, polypropylene, polyamide, polyester, polycarbonate, etc.), cement e.g. Portland cement, limestone, chalk, quick lime, slaked or hydrated lime, ground sand, silica sand flour, quartz flour, amorphous silica, condensed silica fume, microsilica, metalkaolin, wollastonite, mica, perlite, vermiculite, aluminum hydroxide, pigments, anti-foaming agents, flocculants, and other additives.

The independent and dependent claims set out particular and preferred features of the invention. Features from the dependent claims may be combined with features of the independent or other dependent claims, and/or with features set out in the description above and/or hereinafter as appropriate.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

The same reference signs refer to the same, similar or analogous elements in the different figures.

DESCRIPTION OF ILLUSTRATIVE EMBODIMENTS

The present invention will be described with respect to particular embodiments. It is to be noticed that the term "comprising", used in the claims, should not be interpreted as being restricted to the means listed thereafter; it does not exclude other elements or steps. It is thus to be interpreted as specifying the presence of the stated features, steps or components as referred to, but does not preclude the presence or addition of one or more other features, steps or components, or groups thereof. Thus, the scope of the expression "a device comprising means A and B" should not be limited to devices consisting only of components A and B. It means that with respect to the present invention, the only relevant components of the device are A and B.

Throughout this specification, reference to "one embodiment" or "an embodiment" are made. Such references indicate that a particular feature, described in relation to the embodiment is included in at least one embodiment of the present invention. Thus, appearances of the phrases "in one embodiment" or "in an embodiment" in various places throughout this specification are not necessarily all referring to the same embodiment, though they could.

Furthermore, the particular features or characteristics may be combined in any suitable manner in one or more embodiments, as would be apparent to one of ordinary skill in the art.

Figure 1:
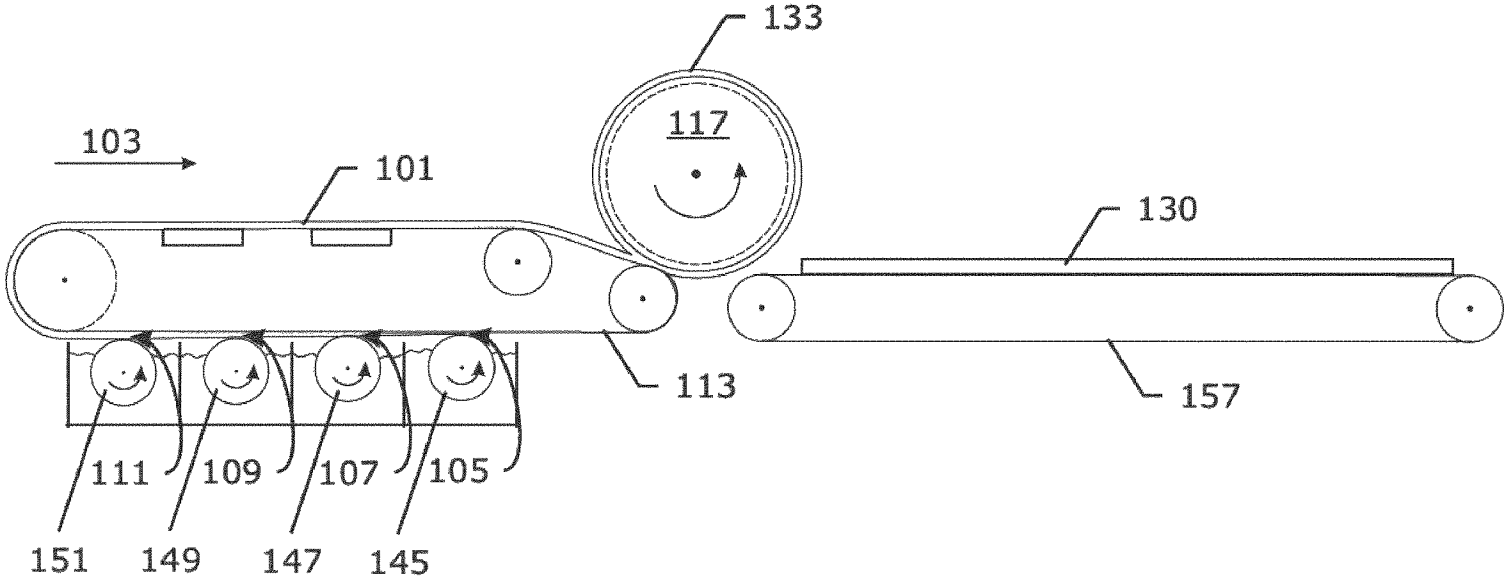
FIG. 1 is a schematically view of a Hatschek process.
Figure 2:
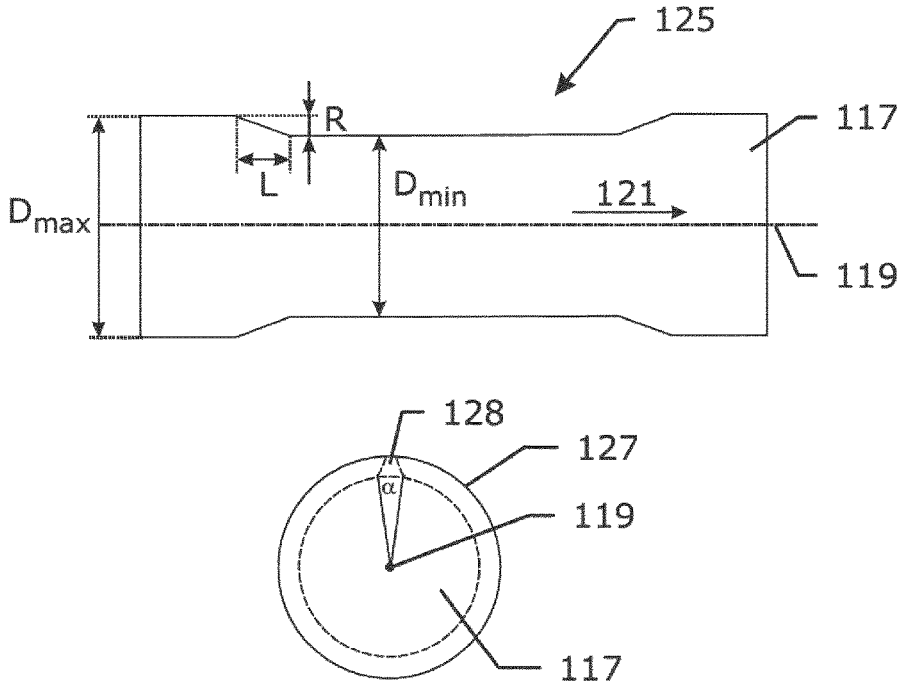
FIG. 2 is schematically view of an accumulator roll used in a process according to the invention.

A typical Hatchek process is shown in FIG. 1. A number of monolayers, in the embodiment shown in FIG. 1, in total four, are created by four rotating sieve drums (145, 147, 149, 151). They are picked up and stacked on an endless transport belt 113, being a water permeable felt or fleece. This felt, after having passed the fourth rotating sieve drum 151, carries a fiber cement multilayered slab 101. As the system may continue to rotate, this is de facto an endless fiber cement multilayered slab. This slab 101, which is transported in production direction 103, is contacted by the rotating accumulator roll 117. On this accumulator roll 117, which according to the invention has a recess 125 in axial direction 121 along at least part of the circumference 127 as shown in FIG. 2, a plurality of fiber cement multilayered slab layers are accumulated by rotating the accumulator roll along its axis 119, until the predefined thickness is obtained. At that moment, the accumulated slab 133 is cut and taken from the roll 117, and laid down on a transport device 153. As such an uncured, profiled fiber cement plate 130 is provided. The uncured, profiled fiber cement plate 130 is further adjusted in dimension, and cured in an appropriate way, e.g. air cured or autoclave cured as the case may be.

In a processes according to the invention, at least one of the sieves, e.g. the first sieve 145, provides a monolayer 105 which has a width W1 which is less than the width of the monolayers 107, 109 and 111, provided by the other sieves 147, 149 respectively 151. The sieves are aligned one to the other in such a way that on the endless belt 113, the monolayer 105 with the smallest width W1 is encompassed, or in this case covered, by the other monolayers, in this embodiment the other three monolayers 107, 109 and 111, which have all a substantially identical width W2.

Figure 3:
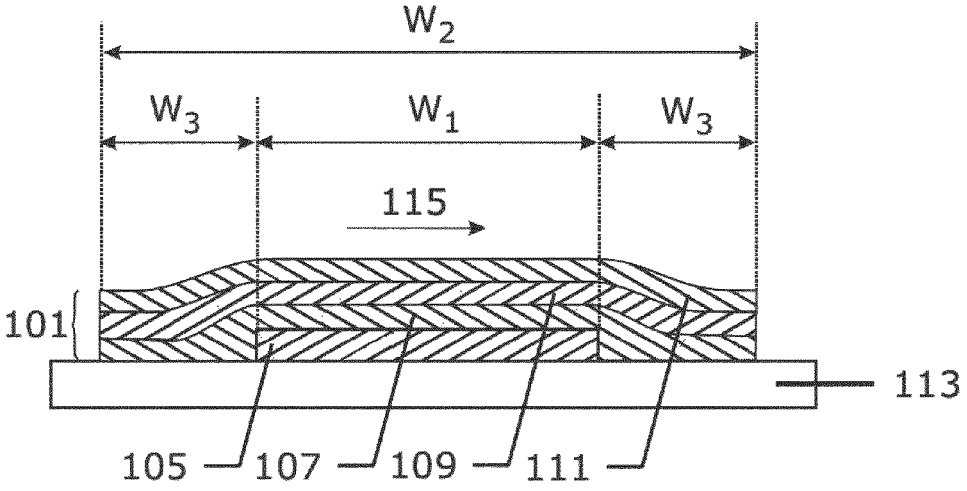
FIG. 3 is schematically view of an endless fiber cement multilayered slab in a production direction according to the invention.

A cross section of the endless fiber cement multilayered slab 101, obtained on the transport device 113 is shown in FIG. 3. In transverse direction 115 to the production direction, one notices that the monolayer 105, laid down first on the transport device 113, is fully covered by the subsequent monolayers 107, 109 and 111.

Figure 4:
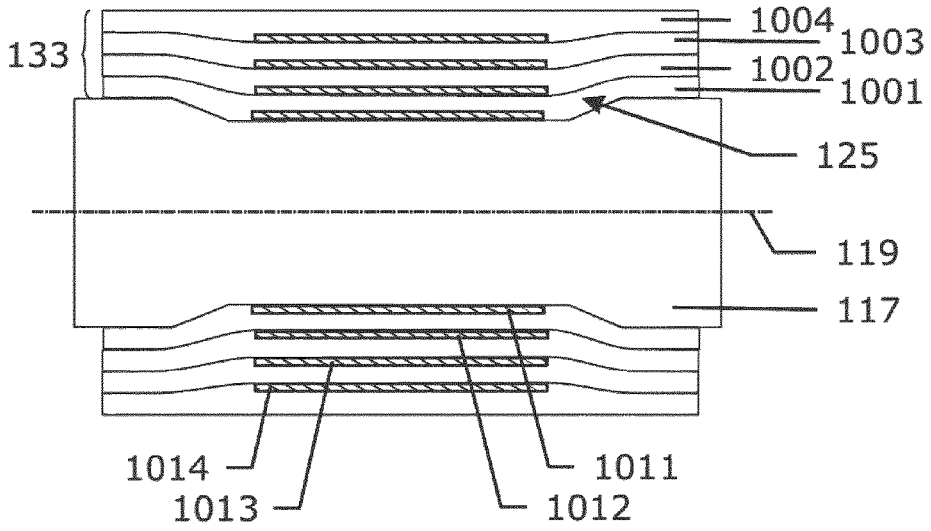
FIG. 4 is schematically view of an accumulator roll on which multiple layers of endless fiber cement multilayered slab are accumulated, according to the invention.
Figure 5:
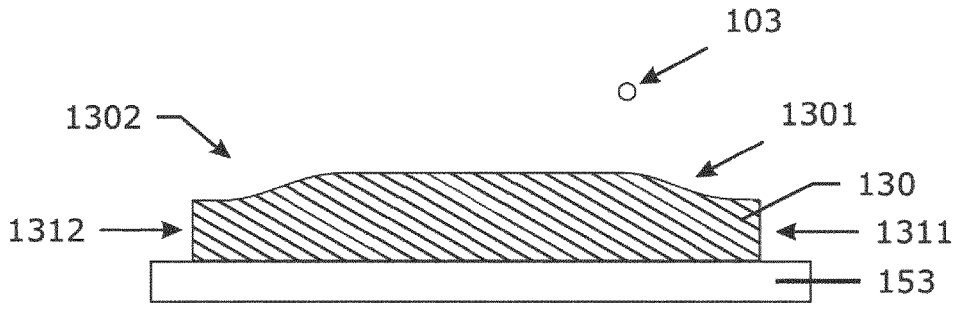
FIG. 5 is schematically view of an uncured, profiled fiber cement plate according to the invention.

As shown in FIG. 4, several layers of this endless fiber cement multilayered slab (1001, 1002, 1003 and 1004) are accumulated on the accumulator roll 117. For each slab, the monolayer with reduced width (1011, 1012, 1013 and 1014) is provided within the recess 125, thereby providing an accumulated slab 133 Once the accumulated slab 133 has reached its desired thickness, the slab 133 is taken from the accumulator roll 117 and laid down on a transport device 153 as shown in FIG. 1, thereby providing an uncured, profiled fiber cement plate 130. The cross section of this uncured fiber cement plate 130, as shown in FIG. 5, has already a tapered of beveled edges 1301 and 1302 at both sides 1311 and 1312 in production direction 103.

Curing the uncured fiber cement plate to provide a profiled fiber cement plate with tapered of beveled edges may be done by e.g. air curing or autoclaved curing. Optionally, at both sides 1311 and 1312, the plate can be cut to the required total width as is usually done in Hatschek production, before curing.

As shown in FIG. 6*a*, a top view of a rotating sieve drum rotating in its slurry containing vat, i.e. sieves 145, 147, 149 or 151 is shown. Each rotating drum 2001 rotates around its axis 2003 in the vat 2005. Along a part of the surface of the rotating drum, the surface is provided with perforations, or is provided in a wire net material 2007, forming a sieve. The width of the sieve is the width W2 of the monolayer which will be formed on the sieve surface when the slurry is sucked from the outside of the sieve towards the inner side of the sieve. The cement, filler, fibers and other material will be retained on the sieve surface, forming the monolayer.

For the first rotating drum sieve 145 in production direction 103, at both ends in axial direction, a zone 2009 and 2010 of the sieve is covered by a water impermeable coating, such as a paint. As such, the monolayer build on this sieve will not build along the covered zones 2009 and 2010, hence resulting in the fact that a monolayer with smaller width W1 will be formed.

It is understood that also alternative sequences, with the sieve drum 145 positioned not in the first station but in one of the second, third or fourth position in the rotating drum sieve train can be used.

Figure 6:
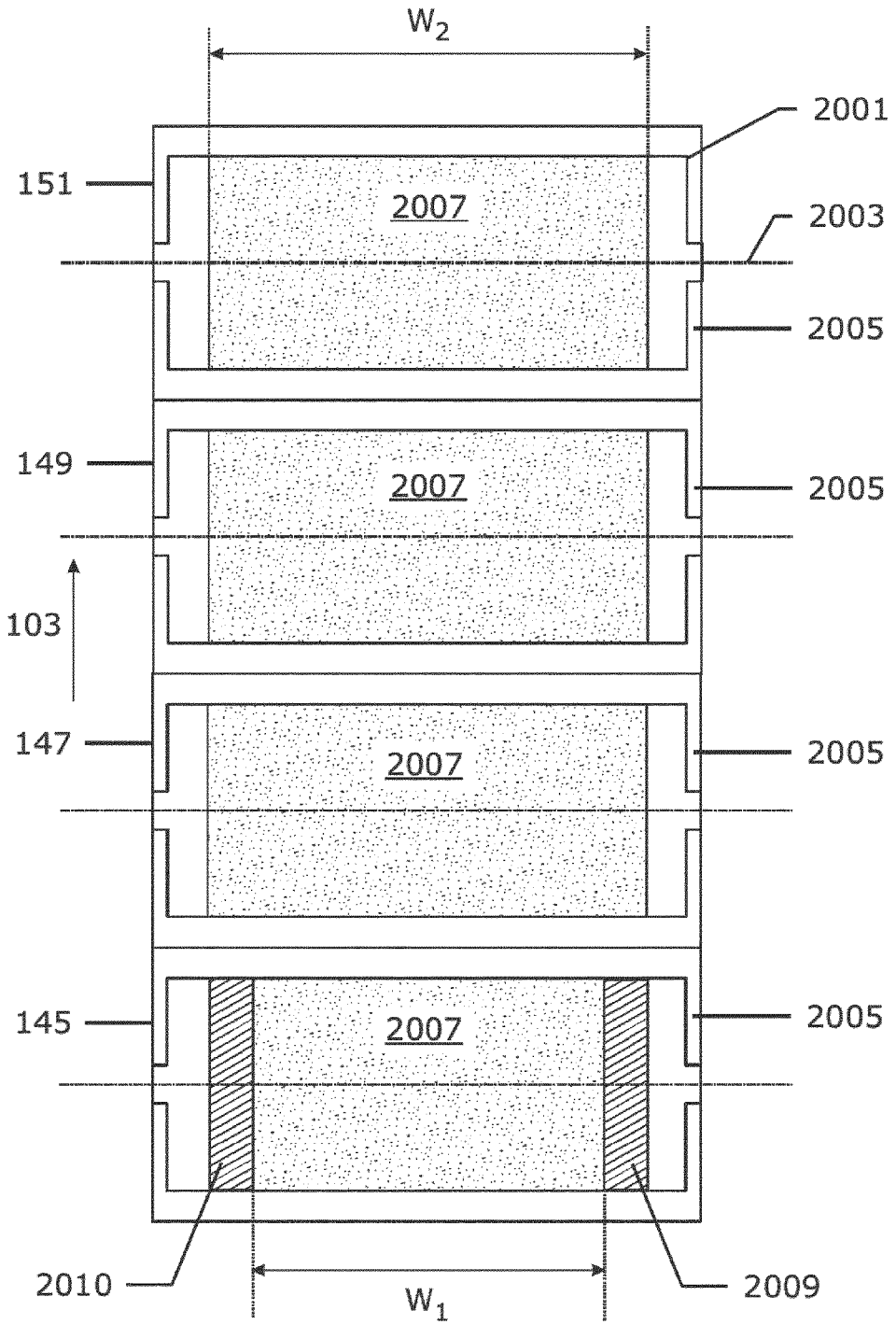
FIGS. 6 and 7 are schematically views of a series of rotating drum sieves as used in a process according to the present invention.

As an example, four rotating drum sieves as shown in FIGS. 1 and 6 are used to form four monolayers. The first monolayer has a width W1 of 1100 mm, the three subsequent monolayers have a with W2 of 1400 mm. The density and composition of the slurry used to provide all four monolayers are identical. The composition of the slurry used is a typical fiber cement slurry comprising water, cement, cellulose fibers, sand and the typical additives. The thicknesses of the monolayers are identical and are 0.25 mm.

As such a fiber cement multilayered slab 101, as shown in FIG. 3, is provided wherein the first monolayer is covered by the three other monolayers. The three other monolayers extend over the first monolayer over a width W3 being, in this sample 150 mm on both sides.

This a fiber cement multilayered slab 101 is accumulated on an accumulation roll 117 with a maximum diameter Dmax of 875 mm, and having a trapezoid-like recess of depth R of 2 mm and a length L of the legs in axial direction of the drum 117 of 15 mm. The minimum diameter Dmin along the recess is 871 mm. So in a zone of length L, the diameter of the accumulator roll gradually changes from Dmin to Dmax.

The accumulator roll, with an approximate circumference of 2750 mm is provided with this recess along 2600 mm, leaving a zone 128 of the circumference with length of 150 mm without recess.

This absence ensured the fresh slab 101 to be picked up by the accumulator roll immediately after removal of the previous accumulated slab.

In an alternative process, the accumulator roll has a recess along its complete circumference, while the installation comprises a means to contact the fresh slab to the accumulator roll immediately after removal of the previous accumulated slab. E.g air jets at the end of the transport belt 113, bowing the slab upwards to the accumulator roll, or vacuum sucking holes in the accumulator roll may lift the fresh slab towards the accumulator roll. A moveable roll fitting within the recess and contacting it with his circumferential surface can be used as well.

5 fiber cement products with tapered edges were made, with 5 different thicknesses (6.5 mm, 7 mm, 8 mm, 8.5 mm and 9.5 mm). 6, 7, 8, 9, respectively 10 layers of slab are accumulated on the accumulator roll to provide the accumulated slab. This accumulated slab is cut and laid down on the transport device. The uncured, profiled fiber cement plate obtained have a width 1400 mm, a maximum thickness of 6.5 mm, 7 mm, 8 mm, 8.5 mm and 9.5 mm and a minimum thickness at the thinner end of the beveled edge of 4.5 mm, 5 mm, 6 mm, 6.5 mm and 7.5 mm.

Figure 8:
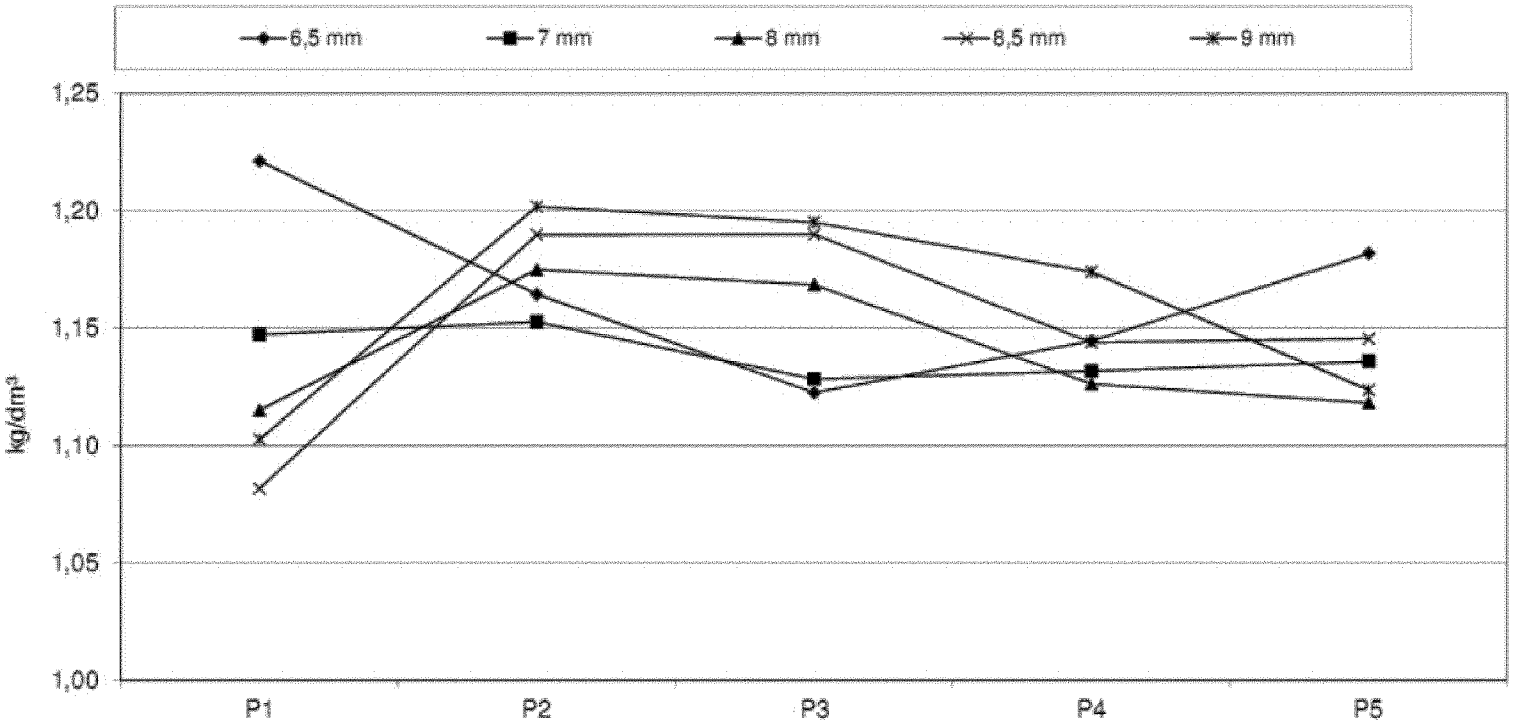
FIG. 8 shows the density profile in transversal direction of an uncured, profiled fiber cement plate according to the invention.
Figure 9A:
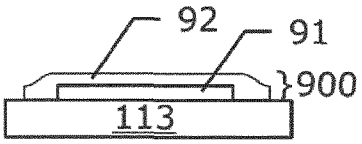
FIGS. 9*a* to 9*j* are schematically views of endless fiber cement multilayered slabs in a production direction according to the invention.
Figure 9B:
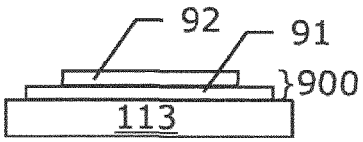
Figure 9C:
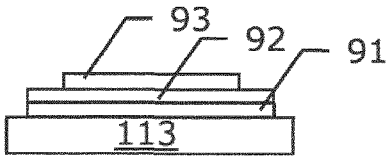
Figure 9D:
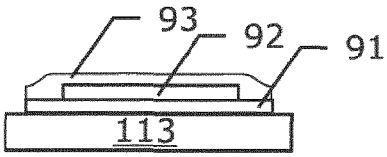
Figure 9E:
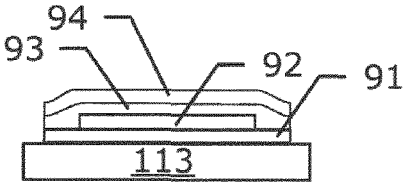
Figure 9F:
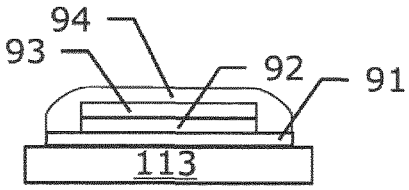
Figure 9G:
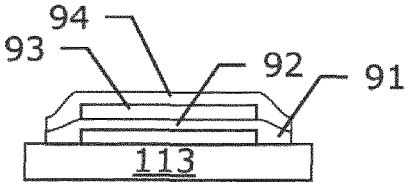
Figure 9H:
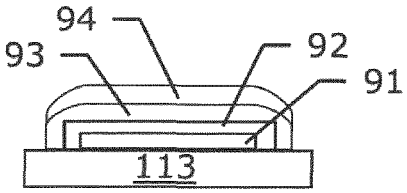
Figure 9I:
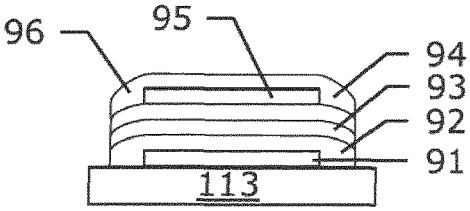
Figure 9J:
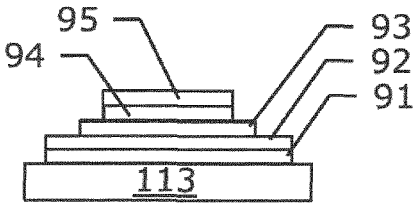

The density profiles of the uncured, profiled fiber cement plate is shown in FIG. 8. On 5 positions, the density of the uncured, profiled fiber cement plate was measured. Position P3 is in the middle of the uncured, profiled fiber cement plate in transversal direction. P2 and P4 are at ¼ the of the width of the uncured, profiled fiber cement plate measured from the respective edges. P1 and P5 are at the tapered edges of the uncured, profiled fiber cement plate.

The uncured, profiled fiber cement plate is reduced to the commercial width at both sides of the beveled edge profile, is air dried and hence a profiled fiber cement plate is provided.

Figure 7:
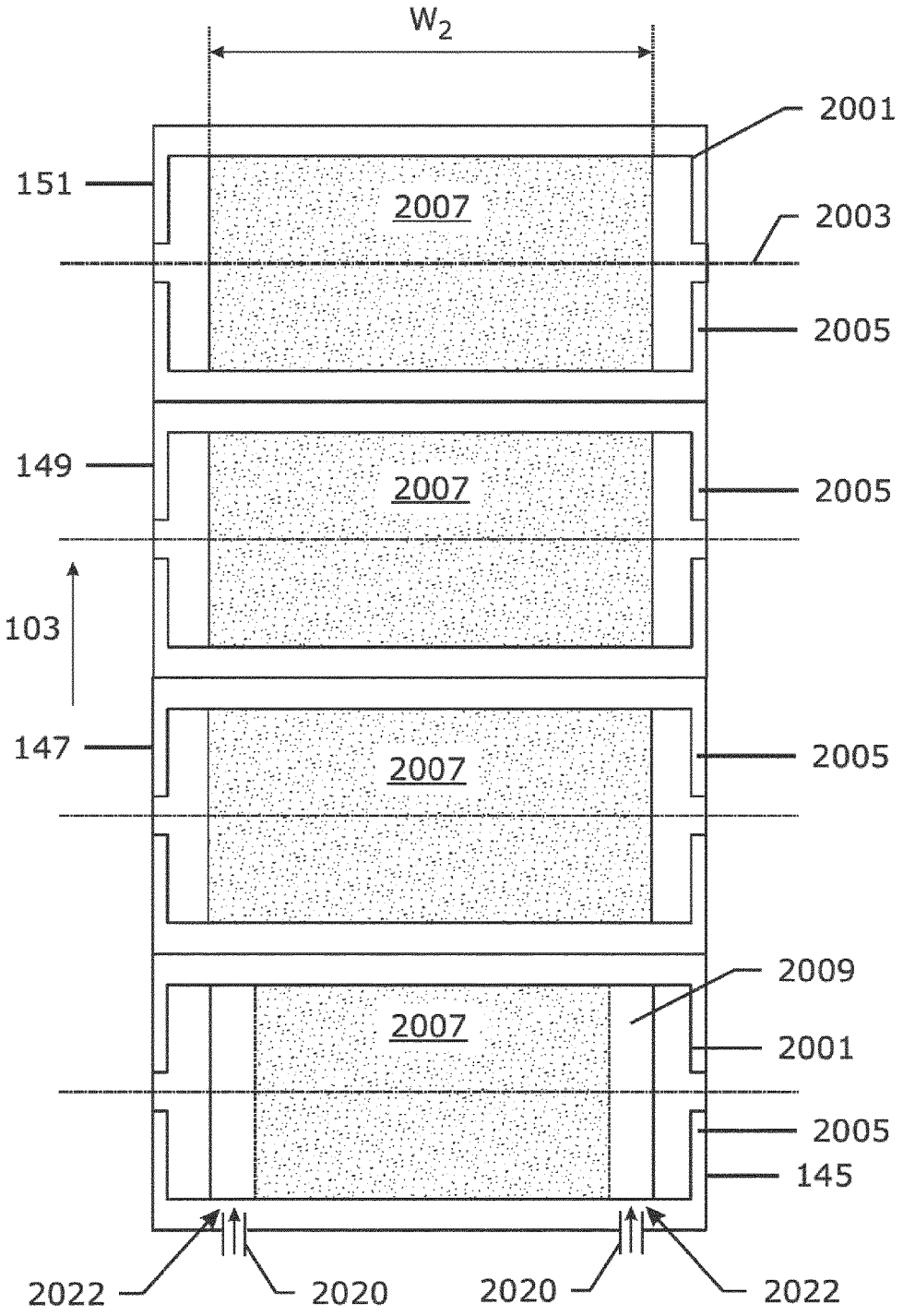

As an alternative set up shown in FIG. 7, for the first rotating drum sieve 145 in production direction 103, at both ends in axial direction, a zone 2009 and 2010 of the sieve sprayed by a water spraying device 2020, spraying water 2022 to the zones 2009 and 2010. The monolayer build in this zone is sprayed away from the sieve, forming a monolayer with smaller width W1. This has the advantage that the width of the monolayer can be varied in time, i.e. for providing the first layer of multilayered slab, the sprayers can be activated, hence a multilayered slab comprising a monolayer with reduced with can be provided and accumulated, while, for the all or some of the consecutive accumulated layers on the accumulator roll, the sprayers can be deactivated, providing multilayered slabs consisting of monolayers with all identical widths.

It is understood that, in line with the invention, more or less than four, but at least 2 monolayers can be offered and accumulated on the accumulator roll. Also that the order of more wide and less wide monolayers may be varied. Also that that stacks of monolayers having mutually different widths may be used. Some alternative cross sections of the endless fiber cement multilayered slab are shown in FIGS. 9*a* to 9*j*, wherein 91, 92, 93, 94, 95 and 96 are monolayers stacked to provide an endless fiber cement multilayered slab 900 according to the present invention.

It is to be understood that although preferred embodiments and/or materials have been discussed for providing embodiments according to the present invention, various modifications or changes may be made without departing from the scope and spirit of this invention.

The invention claimed is:

1. A Hatschek process for the production of a profiled fiber cement plate, comprising the steps of:

providing an endless fiber cement multilayered slab (101) in a production direction (103) by stacking a first monolayer (105) having a first width (W1) in a transverse direction (115) and a second monolayer (107) having a second width (W2) in said transverse direction (115), said first width (W1) being less than said second width (W2), and the second monolayer (107) extending in said transverse direction (115) beyond the first monolayer (105);

accumulating at least one layer of said endless fiber cement multilayered slab on a profiled accumulator roll (117), said accumulator roll having a recess (125) in an axial direction (121) along at least part of a circumference (127) thereof, whereby the first monolayer (105) is situated within said recess (125), thereby providing an accumulated slab (133);

removing said accumulated slab (133) from the accumulator roll (117), thereby providing an uncured, profiled fiber cement plate (130); and curing said uncured fiber cement plate (130) to provide said profiled fiber cement plate.

2. The Hatschek process according to claim 1, wherein the recess (125) has a depth of between 0.5 mm and 3 mm.

3. The Hatschek process according to claim 1, wherein the difference between said width (W1) of said first monolayer (105) in said transverse direction (115) and the width (W2) of said monolayer (107) is at least 40 mm.

4. The Hatschek process according to claim 1, wherein said multilayered slab further comprises n additional second monolayers, n being an integer of at least 1, said width of each of said n additional second monolayers in said transverse direction is more than the first width of said first monolayer (105), and each of said n additional second monolayers extends in said transverse direction beyond the first monolayer (105).

5. The Hatschek process according to claim 1, wherein said recess (125) has a trapezoid shape, the length of a radial projection of each of legs of said trapezoid shape on the axis of said accumulator roll (117) is in the range of 2 to 20 mm.

6. The Hatschek process according claim 1, wherein said multilayered slab further comprises m additional first monolayers, m being an integer of at least 1.

7. The Hatschek process according to claim 1, wherein said multilayered slab comprises a total of 2 to 8 monolayers of said first and second monolayers.

8. The Hatschek process according to claim 1, wherein the first monolayer has a thickness different from the thickness of the second monolayer.

9. The Hatschek process according to claim 1, wherein each of said first and second monolayers is formed by accumulating fiber cement slurry on a rotating sieve drum and removing said accumulated fiber cement slurry from said rotating sieve drum as a monolayer, the width of said first monolayer in said transverse direction being formed by obstructing at least part of the sieve at outer ends thereof in an axial direction of the rotating sieve drum.

10. The Hatschek process according to claim 1, wherein each of said first and second monolayers is formed by accumulating fiber cement slurry on a rotating sieve drum and removing said accumulated fiber cement slurry from said rotating sieve drum as a monolayer, the width of said first monolayer in said transverse direction being formed by removing part of the accumulated fiber cement slurry from the sieve extending beyond the width to be formed.

11. The Hatschek process according to claim 10, wherein the slurry is removed by spraying water onto the slurry to be removed.

12. The Hatschek process according to claim 1, wherein said accumulator roll has no recess (125) in the axial direction (121) along at least 40 mm of its circumference.

13. The Hatschek process according to claim 1, wherein said accumulator roll (11) has the recess (125) in the axial direction (121) along a complete circumference thereof, the process further comprising using means to contact the respective layer of said endless fiber cement multilayered slab in the recess at start of accumulation of the layer on the profiled accumulator roll.

* * * * *